United States Patent [19]

Lee

[11] Patent Number: 4,844,780

[45] Date of Patent: Jul. 4, 1989

[54] BRIGHTENER AND AQUEOUS PLATING BATH FOR TIN AND/OR LEAD

[75] Inventor: Joseph H. Lee, Northbrook, Ill.

[73] Assignee: Maclee Chemical Company, Inc., Chicago, Ill.

[21] Appl. No.: 157,300

[22] Filed: Feb. 17, 1988

[51] Int. Cl.[4] ..... C25D 3/32; C25D 3/36; C25D 3/56; C25D 3/60

[52] U.S. Cl. ..... 204/44.4; 204/53; 204/54.1; 204/DIG. 2

[58] Field of Search ..... 204/44.4, 54.1, 53, 204/DIG. 2

[56] References Cited

U.S. PATENT DOCUMENTS

| | | | |
|---|---|---|---|
| 2,271,209 | 1/1942 | Schlotter | 428/639 |
| 2,512,719 | 6/1950 | Hull | 204/54.1 |
| 3,361,652 | 1/1968 | Korpiun | 204/54.1 |
| 3,634,212 | 1/1972 | Valayil et al. | 204/54.1 |
| 3,755,096 | 8/1973 | Passal | 204/54.1 |
| 3,785,939 | 1/1974 | Hsu | 204/43 S |
| 3,905,878 | 9/1975 | Dohi et al. | 204/44.4 |
| 3,977,949 | 8/1976 | Rosenberg | 204/54.1 |
| 4,000,047 | 12/1976 | Ostrow et al. | 204/44.4 |
| 4,089,755 | 5/1978 | Steinecker | 204/55.1 |
| 4,132,610 | 1/1979 | Dohi et al. | 204/44.4 |
| 4,384,930 | 5/1983 | Eckles | 204/44.4 |
| 4,388,158 | 6/1983 | Tokuyama et al. | 204/27 |
| 4,417,957 | 11/1983 | Rosenberg | 204/54.1 |
| 4,440,608 | 4/1984 | Opaskar et al. | 204/44.4 |
| 4,459,185 | 7/1984 | Obata et al. | 204/43 S |
| 4,530,741 | 7/1985 | Rosenberg | 204/54.1 |
| 4,545,870 | 10/1985 | Rosenberg | 204/54.1 |
| 4,565,609 | 1/1986 | Nobel et al. | 204/44.4 |
| 4,565,610 | 1/1986 | Nobel et al. | 204/44.4 |
| 4,582,576 | 4/1986 | Opaskar et al. | 204/44.4 |
| 4,599,149 | 7/1986 | Nobel et al. | 204/44.4 |
| 4,617,097 | 10/1986 | Nobel et al. | 204/44.4 |
| 4,640,746 | 2/1987 | Nobel et al. | 204/15 |
| 4,662,999 | 5/1987 | Opaskar et al. | 204/44.4 |

FOREIGN PATENT DOCUMENTS

| | | | |
|---|---|---|---|
| 1030209 | 6/1966 | United Kingdom | 204/54.1 |

OTHER PUBLICATIONS

J. B. Mohler, Electroplating and Related Processes, Chemical Publishing Co., Inc. New York (1969) pp. 140–151, 179–184.

*Primary Examiner*—G. L. Kaplan

*Attorney, Agent, or Firm*—Dressler, Goldsmith, Shore, Sutker & Milnamow, Ltd.

[57] ABSTRACT

The brightener for an aqueous tin, lead or tin-lead alloy plating bath comprises an effective amount of a primary brightening agent including glutaraldehyde, an effective amount of a secondary brightening agent selected from the group consisting of lower aliphatic and aromatic aldehydes, surface active and levelling agents for the entire range of current densities of from about 20 amperes per square foot to about 250 amperes per square foot, a stabilizing and deoxidizing agents including N.N.[1]-di-sec-butyl-p-phenylenediamine, and an organic solvent.

9 Claims, No Drawings

BRIGHTENER AND AQUEOUS PLATING BATH FOR TIN AND/OR LEAD

This invention relates to the electrodeposition of tin, lead and tin-lead alloys, and particularly to a plating bath which is free of sulfonic acid and/or sulfonates and which deposits smooth and bright tin and/or lead coatings.

Aqueous plating baths for depositing tin and/or lead coatings on substrates have been known in the art, and most of these baths contain in addition to the water soluble tin and/or lead salts, fluoroborates, fluorosilicates, sulphuric acid, sulfonic acid or the like. Baths containing fluoroborates generally are corrosive and toxic, but provide good plating characteristics.

Tin and/or lead plating baths are known to include additives which improve the brightness of the deposit obtained from the baths. For example, the use of the naphthalene chlorobenzaldehyde either alone or in combination with other substituted olefins improve the brightness of the deposited plate. Other ingredients which have been suggested as being useful in tin and/or lead plating baths include combinations of aldehydes, ketones, napthaldehydes and amines. For instance, the plating bath described in U.S. Pat. No. 3,785,939 for producing a bright deposit of tin and load alloys comprises a combination of nonionic polyoxyalkylated surfactant, a lower aliphatic aldehyde, an aromatic aldehyde, and an amine.

Other patents relating to plating bath formualtions have suggested the deposition of tin and/or lead coatings wherein the baths contain no fluoroborate. For example, U.S. Pat. No. 4,459,185 as well as U.S. Pat. No. 4,582,576 describe plating baths which are prepared by using one or more of the specified cationic anphoteric and/or nonionic surfactants and one or more leveling agents to a principal plating bath which contains an alkane sulfonic or alkanol sulfonic acid and either a divalent tin salt or a divalent lead salt of the sulfonic acids or a mixture of these. The patent suggests a performance of such plating baths is comparable or even superior to plating baths containing fluoroborates. A variety of levelling agents including benzaldehyde derivatives are described.

It has now been found that a smooth, level and bright deposit of tin, lead or tin-lead alloy can be deposited on a substrate from an aqueous plating bath which contains no sulfonate or sulfonic acid. The aqueous plating bath of the invention comprises a bath which contains a brightener of a specified composition. The brightener which may be sold separately or in combination with the bath contains an effective amount of a primary brightening agent, an effective amount of a secondary brightening agent, surface active and levelling agents for the entire range of current densities applicable in a plating bath and a stabilizing and deoxidizing agent including N.N.[1]-di-sec-butyl-p-phenylenediamine in an organic solvent.

The principal object of the invention is to provide a brightener for an aqueous tin, lead or tin-lead plating bath which produces a smooth bright finish, yet is easy to work with and is stable in use.

The preferred concentrations of the preferred embodiment are set forth in Table I.

TABLE I

PREFERRED CONCENTRATIONS

| | g/l limits in brightener | g/l limits in tin plating solution |
|---|---|---|
| Primary Brightening Agents | | |
| Benzylideneacetone | 10–30 | 0.4–1.2 |
| Glutaraldehyde | 10–30 | 0.4–1.2 |
| Secondary Brightening Agents | | |
| Acetaldehyde | 20–60 | 0.8–2.4 |
| Benzaldehyde | 5–20 | 0.2–0.8 |
| Surface Active & Levelling Agents | | |
| Polyoxyethylene (15)-nonylphenol | 10–50 | 0.4–2.0 |
| Cocodiethanolamide | 10–30 | 0.4–1.2 |
| Polyoxy (15) cocoamine | 30–60 | 1.2–2.4 |
| Enhances Leveling & Brightening | | |
| Methacrylic Acid | 20–60 | 0.8–2.4 |
| Solvent | | |
| Methanol | 100–200 | 4.0–8.0 |
| Deoxidizing Agents | | |
| Catechol | 5–10 | 0.2–0.4 |
| N.N.[1]-di-sec-butyl-p-phenylenediamine | 0.1–1.0 | .004–.040 |

The primary brightening agents can be used alone or in combination. In general, if the primary brightening agent benzylideneacetone is present is an amount less than about 10 g/l in the brightner or less than 0.4 g/l in the plating solution a lower brightening range occurs, and if it is present in an amount greater than about 30 g/l in the brightener or 1.2 g/l in the plating solution, then the plated metal is subject to dark discoloration. Should glutaraldehyde be present in less than 10 g/l in the brightener or 0.4 g/l in the plating solution, then the plate is less bright and if it is present in an amount greater than 30 g/l in the brightener or 1.2 g/l in the plating solution then there is also increased brittleness.

If the secondary brightening agent acetaldehyde is present in an amount less than 20 g/l in the brightener or 0.8 g/l in the plating solution, then the coating will not have full effect and it is present in an amount greater than 60 g/l in the brightener or 2.4 g/l in the plating solution, then the plate will be less bright. If benzaldehyde is present in an amount less than 5 g/l in the brightener or 0.2 g/l in the plating solution, the plate will be less bright and if present in an amount greater than 20 g/l in the brightener or 0.8 g/l in the plating solution, then the plate will be discolored.

As regards the surface active and levelling agents, should the polyoxyethylene (15) nonylphenol be present in an amount less than 10 g/l in the brightener or 0.4 g/l in the tin plating solution, the low current density is not covered in dark areas or produced and if the compound is present in an amount greater than about 50 g/l in the brightener or 2.0 g/l in the plating bath, then the plate is dark at low current densities. For the cocodiethanolamine, if such compound is present in an amount less than about about 10 g/l in the brightener or 0.4 g/l in the plating solution, it has no effect and if it is present in an amount greater than about 30 g/l in the brightener or 1.2 g/l in the plating solution, the clarity of the solution is adversely effected. The polyoxy (15) cocoamine if present less than about 30 g/l in the brightener or 1.2 g/l in the plating solution does not level the solution, and if it is present in an amount greater than about 60 g/l in the brightener or 2.4 g/l in the plating bath results in a loss of brightness.

With respect to the methacrylic acid, if it is present in an amount less than about 20 g/l in the brightener or 0.8 g/l in the plating solution, it results in dull areas of low current; whereas if it is present in an amount greater than about 60 g/l in the brightener or 2.4 g/l in the plating solution, it results in dull areas of high current. It should be remembered that the current densities envisioned with the plating baths of the invention are in the range of from about 20 ampere per square foot to about 250 ampere per square foot.

The methanol is present in an amount less than about 100 g/l in the brightener or 4.0 g/l in the tin plating solution provides a turbid solution wherein the components are not soluble and if present in an amount greater than about 200 g/l in the brightener or 8 g/l in the tin plating bath or solution adversely affects the brightness of the deposited coating or plate. The deoxidizing agents are important and one used is catechol and if present in an amount of less than 5 g/l in the brightener or 0.2 g/l in the tin plating solution or bath results in an unstable solution whereas if present in an amount greater than 10 g/l in the brightener or 0.4 g/l in the tin plating solution adversely affects brightness resulting in dull areas of the deposited coating. The N.N$^1$-di-sec-butyl-p-phenylenediamine if present in an amount less than 0.1 g/l per liter in the brightener or 0.004 g/l in the bath is not effective and if present in an amount greater than about 1.0 g/l per liter in the brightener or 0.04 g/l in the bath results in dull areas which are not bright and adversely effect the invention.

The brightener of the invention is normally sold to the ultimate customer who then uses the brightener in diluted form in the aqueous tin plating bath. The bath contains the required metal salts, acids and water to dilute the brightener. Generally, the brightener is used in an amount in the range of about 3 volume percent to about 5 volume percent with the normal usage being at about 4 volume percent brightener to bath. In some instances the brightener is known in the industry as a starter.

The amounts of the primary and secondary brighteners as well as other ingredients are set forth in Table I but it should be understood that the amounts can be varied greatly within the ranges set forth in the Table, as is understood in the plating art. It is within the ordinary skill in the art to vary the concentrations of each ingredient and for that matter to use all of one ingredient and none of another in order to compensate for variations in each plating bath and for variations in the end products desired. In general, the invention contemplates a combination of the two primary brightening agents and a combination of two secondary brightening agents as indicated in the Table. Similarly, the invention contemplates the surface active and levelling agents named as well as the deoxidizing agents named; however, only the N.N.$^1$-di-sec-butyl-p-phenylenediamine is required.

While there has been disclosed what is considered to be the preferred embodiment of the present invention, it is understood that various changes in the details may be made without departing from the spirit, or sacrificing any of the advantages of the present invention.

I claim:

1. A brightener for an aqueous tin, lead or tin-lead alloy acidic plating bath comprising a primary brightening agent comprising about 10 to about 30 grams of glutaraldehyde, or about 10 to about 30 grams of benzylideneacetone or a mixture thereof per liter of brightener; a secondary brightening agent comprising about 20 to about 60 grams of acetaldehyde and about 5 to about 20 grams of benzaldehyde per liter of brightener; a surface active and leveling agent comprising about 10 to about 50 grams of polyoxyethylene (15)-nonylphenol, about 10 to about 30 grams cocodiethanolamide and about 30 to about 60 grams polyoxy (15) cocoamine per liter of brightener; methanol in an amount of about 100 to about 200 grams per liter of brightener; methacrylic acid in an amount in the range of about 20 to about 60 grams per liter of brightener; and a deoxidizing agent comprising about 0.1 to about 1.0 grams N.N.$^1$-sec-butyl-p-phenylenediamine per liter of brightener.

2. An aqueous plating bath comprising at least one bath-soluble metal salt selected from the group consisting of a stannous salt, a lead salt and a mixture of stannous and lead salts, acid and about 3 to about 5 volume percent of the brightener of claim 1.

3. The brightener in accordance with claim 1 wherein both glutaraldehyde and benzylideneacetone are present in an amount of about 10 to about 30 grams per liter of brightener.

4. An aqueous plating bath comprising at least one bath-soluble metal salt selected from the group consisting of a stannous salt, a lead salt and a mixture of stannous and lead salts, acid and about 3 to about 5 volume percent of the brightener of claim 3.

5. The brightener in accordance with claim 1 wherein the stabilizing and deoxidizing agents further comprise catechol present at about 5 to about 10 grams per liter of brightener.

6. An aqueous plating bath comprising at least one bath-soluble metal salt selected from the group consisting of a stannous salt, a lead salt and a mixture of stannous and lead salts, acid and about 3 to about 5 volume percent of the brightener of claim 5.

7. An aqueous tin, lead or tin-lead alloy plating bath comprising at least one bath-soluble metal salt selected from the group consisting of a stannous salt, a lead salt and a mixture of stannous and lead salts; acid; a primary brightening agent comprising about 0.4 to about 1.2 grams per bath liter of glutaraldehyde, or about 0.4 to about 1.2 grams per bath liter of benzylideneacetone or a mixture thereof; a secondary brightening agent comprising about 0.8 to about 2.4 grams acetaldehyde and about 0.2 to about 0.8 grams benzaldehyde per bath liter; surface active and leveling agents comprising polyoxyethylene (15)-nonylphenol present at about 0.4 to about 2.0 grams, cocodiethanolamide present at about 0.4 to about 1.2 grams and polyoxy (15) cocoamine present at about 1.2 to about 2.4 grams per bath liter; methanol present at about 4.0 to about 8.0 grams per bath liter; methacrylic acid present at about 0.8 to about 2.4 grams per bath liter; and a deoxidizing agent comprising about 0.004 to about 0.040 grams per bath liter of N.N.$^1$-di-sec-butyl-p-phenylenediamine.

8. The plating bath in accordance with claim 7 wherein both glutaraldehyde and benzylideneacetone are present in an amount of about 0.4 to about 1.2 grams per bath liter.

9. The plating bath in accordance with claim 7 further including catechol present at about 0.2 to about 0.4 grams per bath liter.

* * * * *